US012569711B1

(12) United States Patent
Nolan et al.

(10) Patent No.: US 12,569,711 B1
(45) Date of Patent: Mar. 10, 2026

(54) LEVER JAMMER ARM EXERCISE MACHINE WITH A LEVER JAMMER ARM ASSEMBLY AND DUAL ARM MECHANISM

(71) Applicant: Bulletproof Fitness Equipment Inc, Acton, CA (US)

(72) Inventors: Lawrence R. Nolan, Santa Clarita, CA (US); Nicole K. Nolan, Santa Clarita, CA (US); Christopher I. Gaddy, Brooklyn, NY (US)

(73) Assignee: Bulletproof Fitness Equipment Inc, Acton, CA (US)

( * ) Notice: Subject to any disclaimer, the term of this patent is extended or adjusted under 35 U.S.C. 154(b) by 202 days.

(21) Appl. No.: 18/476,456

(22) Filed: Sep. 28, 2023

Related U.S. Application Data

(63) Continuation-in-part of application No. 18/334,033, filed on Jun. 13, 2023, now Pat. No. 11,896,867, and a continuation-in-part of application No. 17/955,302, filed on Sep. 28, 2022, now Pat. No. 12,303,739, said application No. 18/334,033 is a continuation-in-part (Continued)

(51) Int. Cl.

| | |
|---|---|
| ***A63B 21/06*** | (2006.01) |
| ***A63B 21/00*** | (2006.01) |
| ***A63B 21/062*** | (2006.01) |
| ***A63B 21/16*** | (2006.01) |

(52) U.S. Cl.
CPC ..... *A63B 21/0615* (2013.01); *A63B 21/0626* (2015.10); *A63B 21/151* (2013.01); *A63B 21/16* (2013.01); *A63B 21/4035* (2015.10); *A63B 2225/093* (2013.01)

(58) Field of Classification Search
CPC ..... A63B 21/0615; A63B 21/0626; A63B 21/151; A63B 21/4035; A63B 21/078; A63B 21/15; A63B 21/0724; A63B 2225/093
See application file for complete search history.

(56) References Cited

U.S. PATENT DOCUMENTS 6,302,833 B1 10/2001 Ellis et al.
7,455,621 B1 11/2008 Anthony
(Continued)

FOREIGN PATENT DOCUMENTS

WO 2023163728 A1 8/2023

OTHER PUBLICATIONS

International Search Report, dated Jul. 12, 2022, issued in International Patent Application PCT/2022/023315, 1 page.

*Primary Examiner* — Megan Anderson
(74) *Attorney, Agent, or Firm* — AVEK IP, LLC

(57) ABSTRACT

A lever jammer arm assembly includes a dual arm mechanism with a carriage to couple the lever jammer arm assembly to a vertical post as part of an exercise machine, the dual arm mechanism having a plate coupled to the carriage and extending therefrom; a first tubular member supported by the plate; and a second tubular member supported by the plate; the first tubular member and the second tubular member can pivot relative to the plate; a weight arm removably secured to the first tubular member such that the weight arm is can pivot with the first tubular member relative to the plate; and a lever arm removably secured to the second tubular member such that the lever arm can pivot with the second tubular member relative to the plate.

20 Claims, 16 Drawing Sheets

Related U.S. Application Data of application No. 17/677,278, filed on Feb. 22, 2022, said application No. 17/955,302 is a continuation-in-part of application No. 17/034,950, filed on Sep. 28, 2020, now Pat. No. 11,517,785, said application No. 17/677,278 is a continuation-in-part of application No. 17/034,950, filed on Sep. 28, 2020, now Pat. No. 11,517,785.

(60) Provisional application No. 63/498,722, filed on Apr. 27, 2023, provisional application No. 63/420,229, filed on Oct. 28, 2022, provisional application No. 63/411,313, filed on Sep. 29, 2022, provisional application No. 63/336,679, filed on Apr. 29, 2022.

(56) References Cited

U.S. PATENT DOCUMENTS

| | | | | |
|---|---|---|---|---|
| 7,918,771 | B2 | 4/2011 | Rogers et al. | |
| 10,799,749 | B2 * | 10/2020 | Sorin | A63B 17/04 |
| 11,173,337 | B2 | 11/2021 | Jones et al. | |
| 12,005,289 | B1 * | 6/2024 | Johnson | A63B 21/154 |
| 12,194,333 | B2 * | 1/2025 | Crandall | A63B 23/1218 |
| 2007/0203002 | A1 | 8/2007 | Webber | |
| 2010/0152001 | A1 | 6/2010 | Gordon | |
| 2013/0184128 | A1 | 7/2013 | Towley, III et al. | |
| 2019/0269963 | A1 | 9/2019 | Steenekamp et al. | |
| 2022/0323815 | A1 * | 10/2022 | Simental | A63B 21/0557 |

* cited by examiner

LEVER JAMMER ARM EXERCISE MACHINE WITH A LEVER JAMMER ARM ASSEMBLY AND DUAL ARM MECHANISM

RELATED APPLICATIONS

This application claims priority to U.S. Provisional Application No. 63/498,722, filed Apr. 27, 2023, and U.S. Provisional Application No. 63/411,313, filed Sep. 29, 2022. This application is also a continuation in part of U.S. application Ser. No. 18/334,033, filed Jun. 13, 2023, which claims priority to U.S. Provisional Application Nos. 63/420,229, filed Oct. 28, 2022 and 63/411,313, filed Sep. 29, 2022, and is further a continuation in part of U.S. application Ser. No. 17/677,278, filed Feb. 22, 2022, which is a continuation in part of U.S. application Ser. No. 17/034,950, filed Sep. 28, 2020. This application is also a continuation in part of U.S. application Ser. No. 17/955,302, filed Sep. 28, 2022, which claims priority from Provisional Application No. 63/336,679, filed Apr. 29, 2022, and is also a continuation in part of U.S. application Ser. No. 17/034,950. All of the foregoing are incorporated by reference in their entireties herein.

FIELD OF INVENTION

The disclosure relates generally to exercise equipment. More specifically, the disclosure relates to a lever jammer arm machine and assembly, with a dual arm mechanism for supporting a weight arm and a lever arm. The lever jammer arm assembly includes a plurality of means of adjustment for both a lever arm and a weight arm and is configured to receive a plurality of selectable user engageable systems, such that the machine can be used for a plurality of exercises.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

According to an embodiment of the current disclosure, the invention includes a lever jammer arm exercise machine, comprising a support structure having a vertical post and a lever jammer arm assembly coupled to the vertical post. The lever jammer arm assembly includes a dual arm mechanism with a carriage coupling the lever jammer arm assembly to the vertical post, the dual arm mechanism having a plate coupled to the carriage and extending therefrom; a first member supported by the plate; and a second member supported by the plate. The first member and the second member are configured to pivot relative to the plate. A weight arm is secured to the first member such that the weight arm is configured to pivot with the first member relative to the plate; and a lever arm secured to the second member such that the lever arm is configured to pivot with the second member relative to the plate. A user engageable system is coupled to the lever arm and configured for operation by a user, the user engageable system is removable and changeable from the lever arm to allow for the lever jammer arm assembly to be used for a plurality of exercises.

In other aspects of the present disclosure, the invention includes the lever jammer arm assembly, having a dual arm mechanism with a carriage to couple the lever jammer arm assembly to a vertical post. The dual arm mechanism includes a plate coupled to the carriage and extending therefrom; a first tubular member supported by the plate; and a second tubular member supported by the plate. The first tubular member and the second tubular member are configured to pivot relative to the plate. A weight arm is removably secured to the first tubular member such that the weight arm is configured to pivot with the first tubular member relative to the plate; and a lever arm is removably secured to the second tubular member such that the lever arm is configured to pivot with the second tubular member relative to the plate.

In yet another aspect of the present disclosure, the invention includes the dual arm mechanism, having a carriage supporting a plurality of rollers and configured to engage with a vertical post; a plate coupled to the carriage and extending therefrom; at least one handle extending from the carriage and configured to allow for a user to traverse the carriage along the vertical post; at least one pin extending from the carriage and configured to secure the carriage at a vertical position along the vertical post; a first member supported by the plate; and a second member supported by the plate. The first member is configured to receive a weight arm and the second member is configured to receive a lever arm.

BRIEF DESCRIPTION OF THE DRAWINGS

Embodiments of the invention are described in detail below with reference to the attached drawings.

The drawings do not limit the invention to the specific embodiments disclosed and described herein. The drawings are not necessarily to scale, emphasis instead being placed upon clearly illustrating various principles of the disclosure.

DETAILED DESCRIPTION

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Exercise equipment is well known in the art and varies from complex machinery to simple devices, wherein a user may select various equipment based on their needs. Those skilled in the art will recognize that adjustability in exercise equipment is desirable. For example, a user may desire to add or remove components from equipment based on a movement they desire to perform. As another example, a user may need to adjust the height or other location of equipment components based on their own physical needs. Yet further, the ability to adapt a single system or machine in different ways and through different means of adjustment, allows for a user to complete a diverse workout with limited units and machinery.

Accordingly, the present invention provides for a lever jammer arm exercise machine 100 with lever jammer arm assemblies 108, 110, each having an associated dual arm mechanism 120, 122. The combination of features allows for a user to make a plurality of adjustments, add varying user engageable systems, and complete their workout, all while using the same core components. Accordingly, the present invention saves space and money, by providing diversity all in one machine. Further, the user can obtain a more complete workout by having the ability to use varied equipment.

Figure 1:
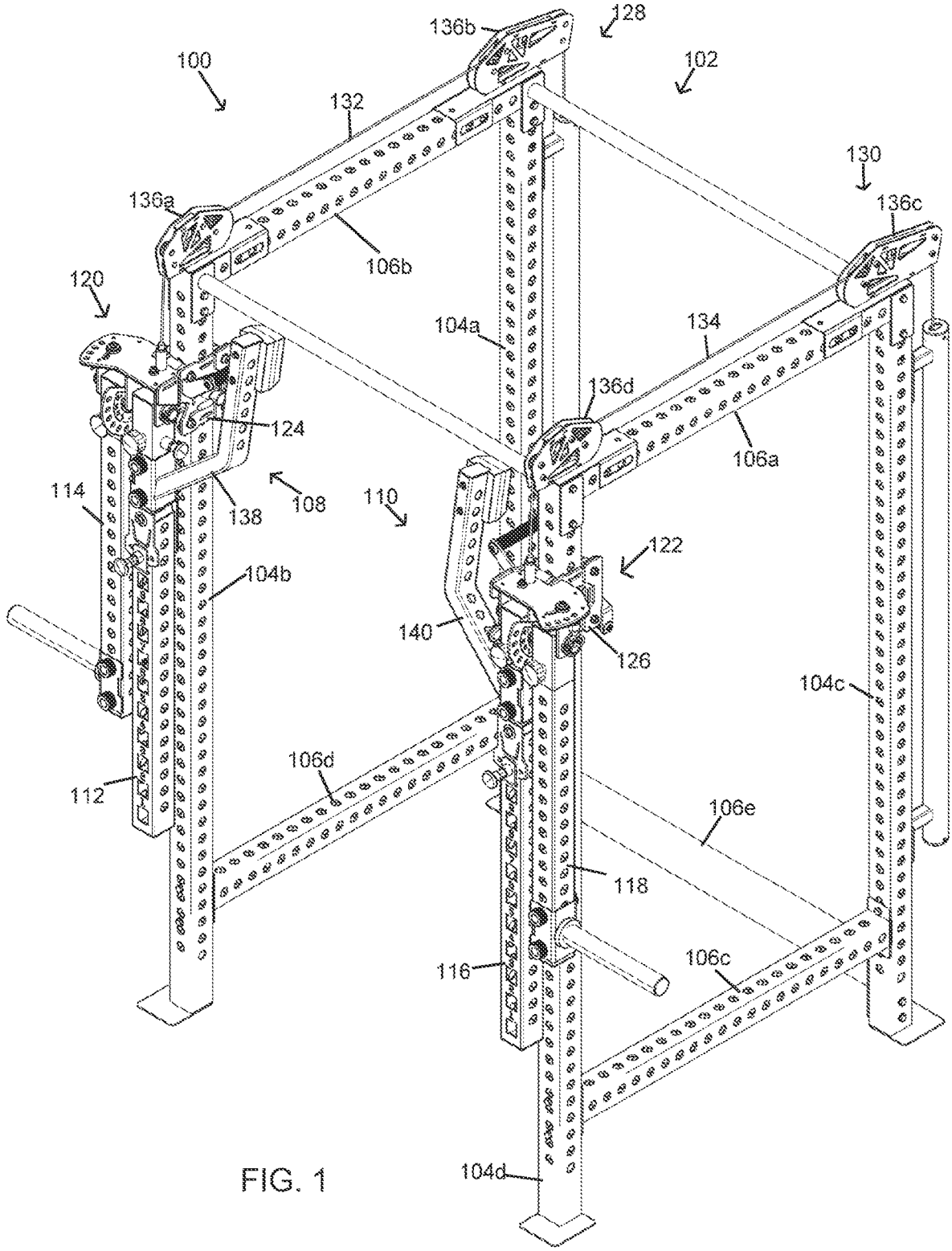
FIG. 1 is a perspective view of a lever jammer arm exercise machine in accordance with the present invention.
Figure 2:
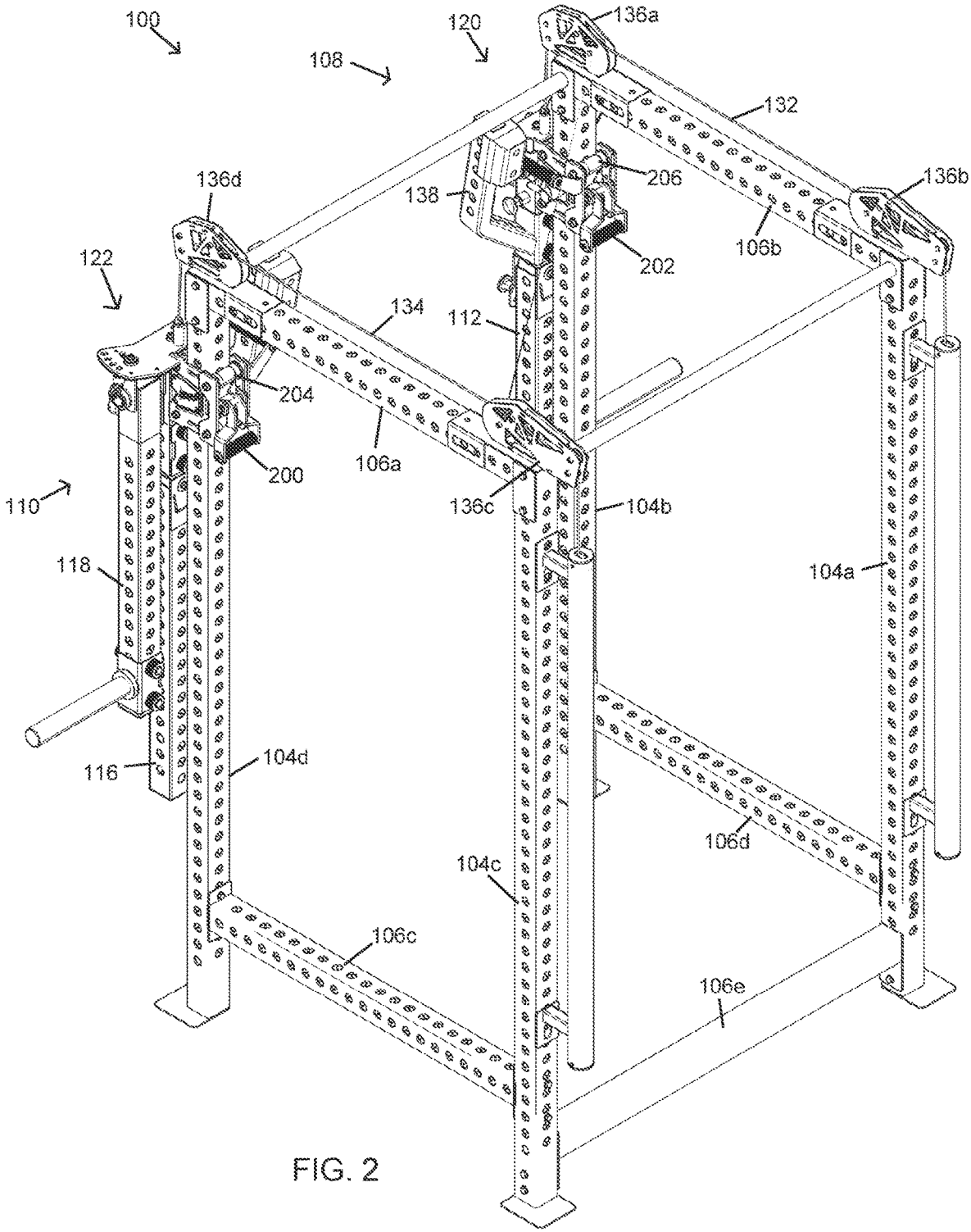
FIG. 2 is another perspective view of the lever jammer arm exercise machine of FIG. 1.

FIGS. 1 and 2 show the lever jammer arm exercise machine 100 having a support structure 102 as the base to support the other components, such as in a home or gym. The support structure 102 rests on the ground surface and may vary as would be understood by those skilled in the art. The support structure 102 includes one or more vertical posts 104*a-d* and one or more horizontal cross bars 106*a-e* to be structurally sound. The support structure 102 will primarily be composed of a sturdy and durable materials, such as a metal or other material capable of providing support. The machine 100 is shown with two lever jammer arm assemblies 108, 110, each secured to an associated one of the vertical posts 104*b*, 104*d* at a predetermined height above the ground surface. The determination of an appropriate height may be based on the physic of the user or the exercise to be performed by the user. It will be appreciated that the lever jammer arm assemblies 108, 110 may be used together, or separately, depending on an exercise selected by the user.

In embodiments, the machine 100 further includes one or more cable systems 128, 130 associated with each of the lever jammer arm assemblies 108, 110. The cable systems 128, 130 will comprise guides 136*a-d* to support cables 132, 134, the cables 132, 134 each independently extending from cable attachments of each of the assemblies 108, 110 as will be discussed in more detail herein. As shown, the cables 132, 134 may extend parallel with and above some of the horizontal cross bars 106*b*, 106*d*, however, it is contemplated that the specific arrangement may vary without departing from the present invention. For example, additional guides, varying styles of guides, and the like may easily be incorporated based on manufacturing, functional, or aesthetic considerations.

Each lever jammer arm assembly 108, 110 includes an associated dual arm mechanism 120, 122 and each dual arm mechanism 120, 122 supports a lever arm 112, 116, and a weight arm 114, 118. The lever arm 112, 116 of each assembly is used to receive a user engageable system (see FIGS. 10-13) and is adjusted in a plurality of planes, as desired for an exercise selected by a user. The weight arm 114, 116 of each assembly is also adjustable and configured to receive one or more weights and provide weighted resistance, depending on the exercise selected. In embodiments, the weight arm 114, 116 of each assembly may be removed and not used during a performed exercise.

Figure 14:
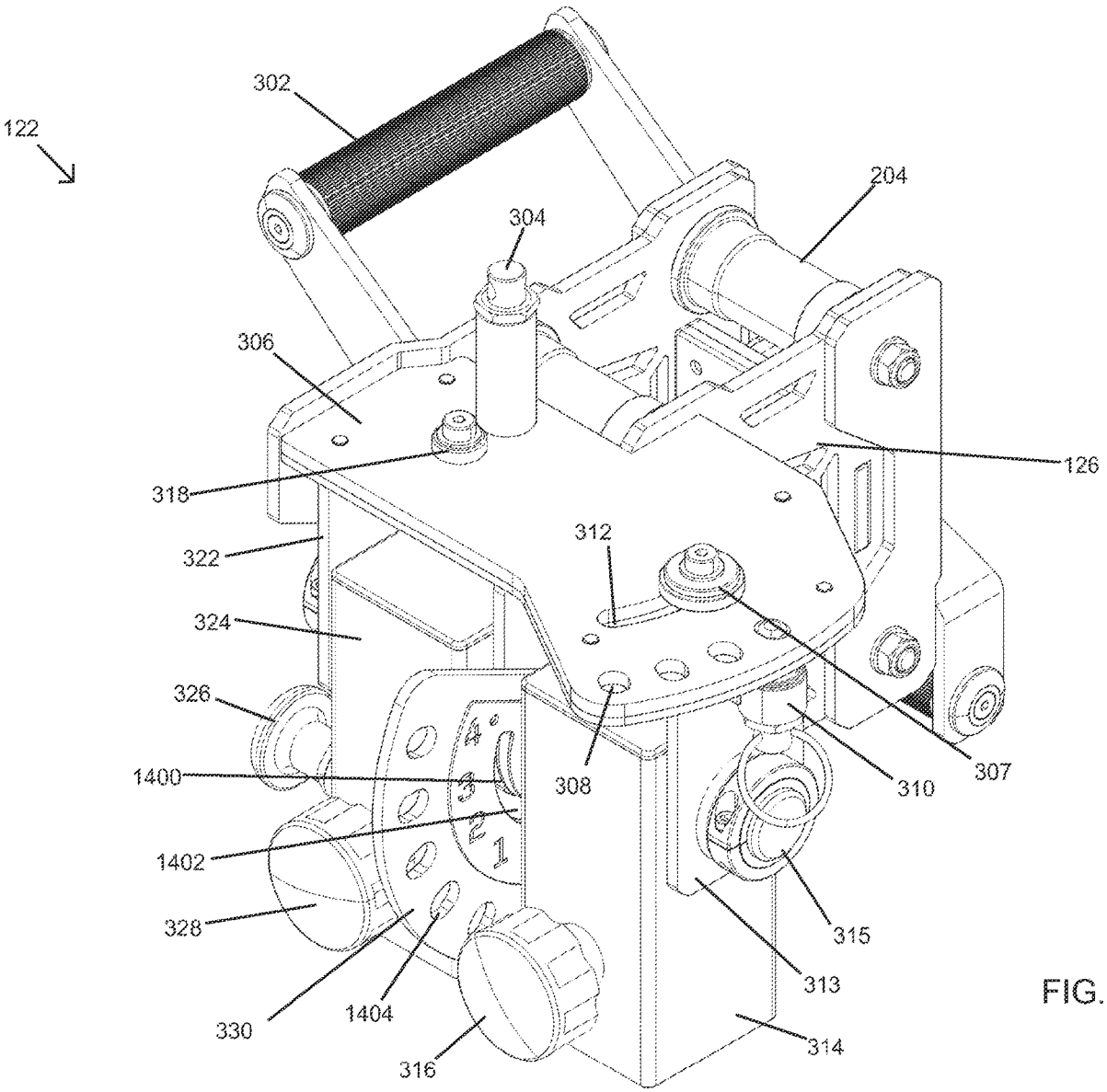
FIG. 14 is a top angled perspective view from a first side of a dual arm mechanism as part of the lever jammer arm machine of FIG. 1.
Figure 15:
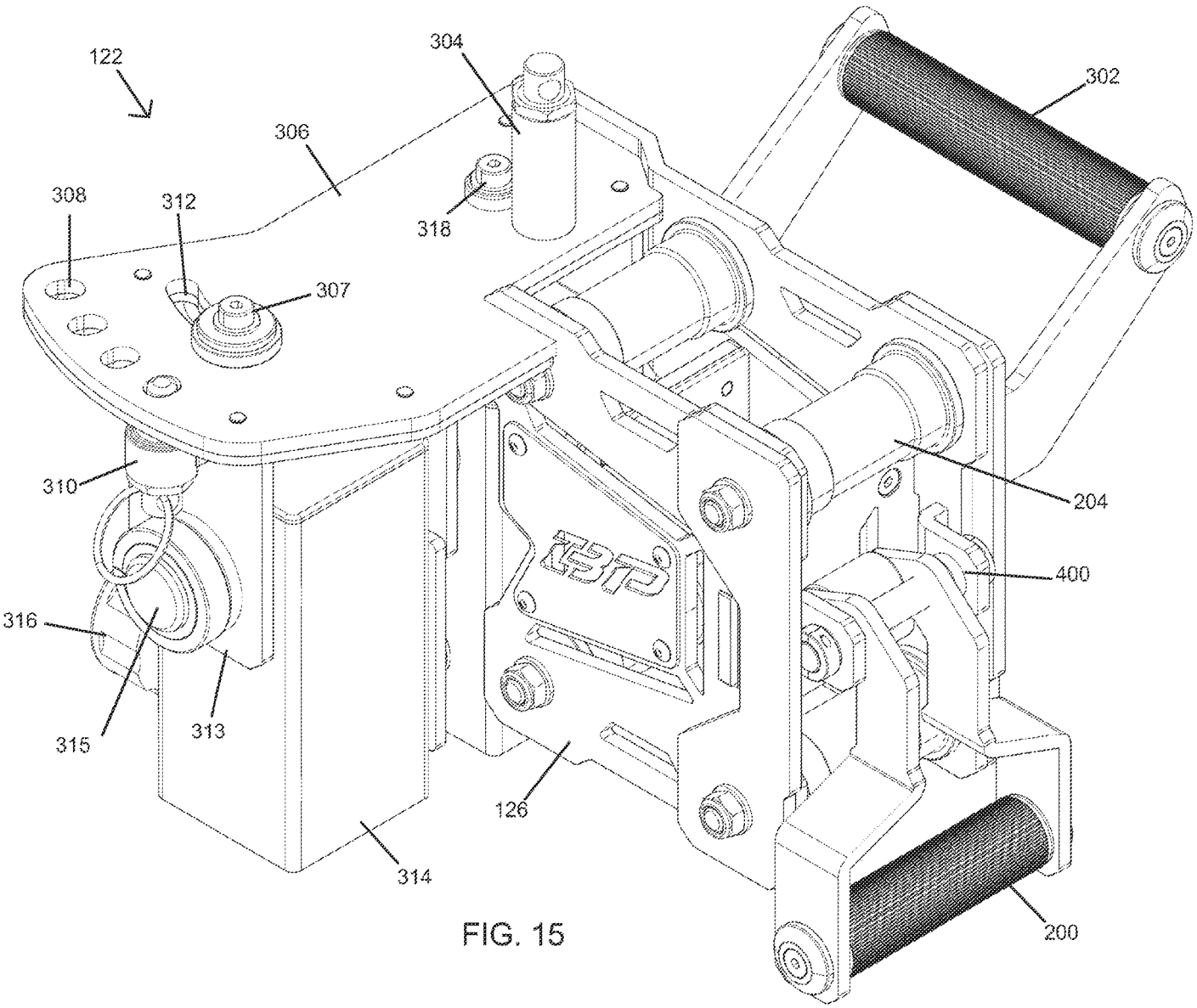
FIG. 15 is a top angled perspective view from a second side of the dual arm mechanism as part of the lever jammer arm machine of FIG. 1.
Figure 16:
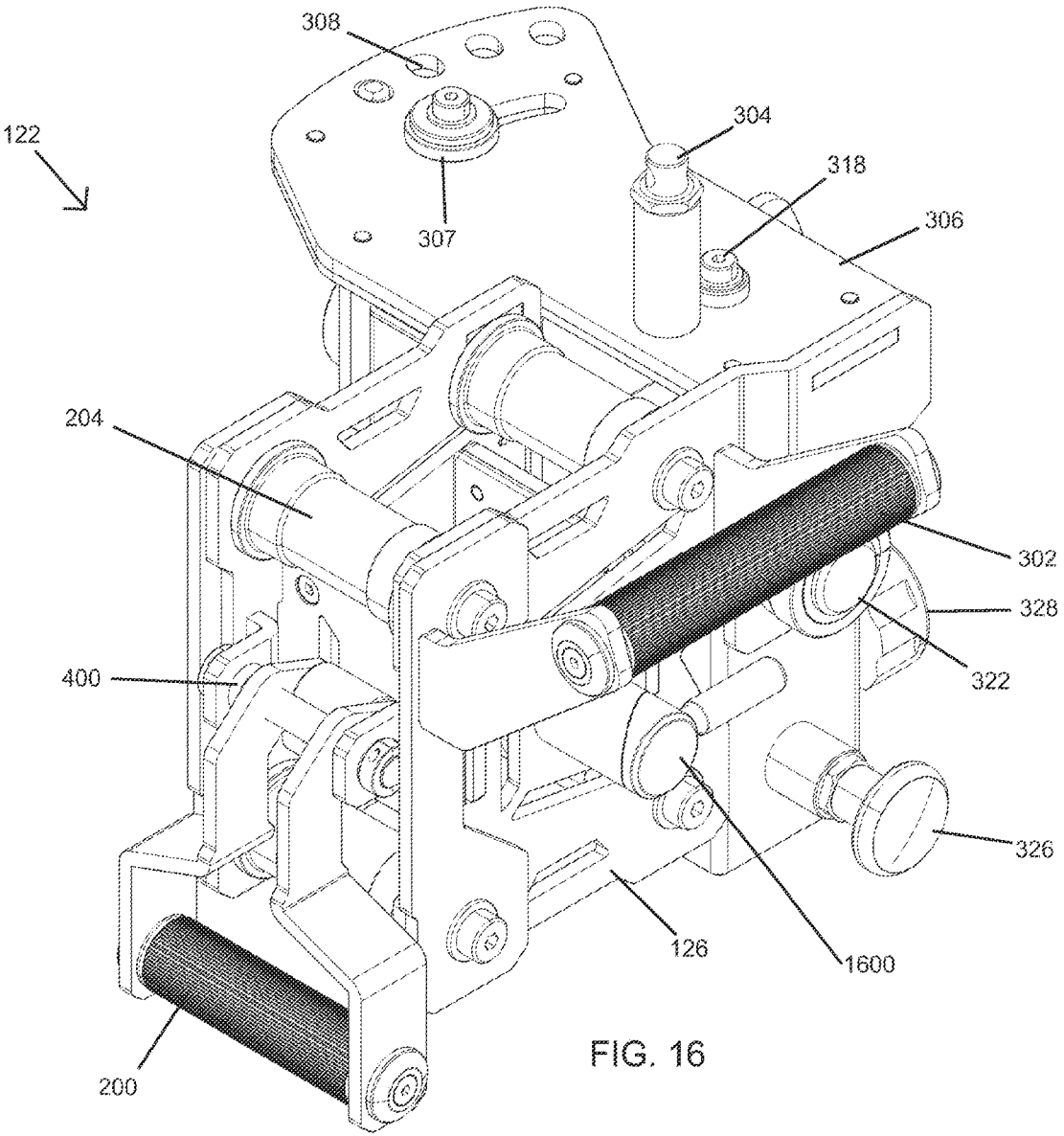
FIG. 16 is a top angled perspective view from a third side of the dual arm mechanism as part of the lever jammer arm machine of FIG. 1.

One of the unique features of the present invention is the dual arm mechanism 120, 122 of each assembly, which is also shown in more detail in FIGS. 14, 15, and 16. The mechanism 120, 122 allows for each assembly to be adjusted along an associated vertical post 104*b*, 104*d* via an associated carriage 124, 126. As shown, each carriage 124, 126 will support rollers 204, 206 and handles 200, 202 for easy user adjustment. In addition, the mechanisms 120, 122 allow for the associated lever arms 112, 116 to be adjusted, such as in a side-to-side plane of adjustment, and a vertical plane of adjustment, both discussed in greater detail herein.

In some embodiments, each assembly 108, 110 further includes a pivot arm 138, 140, attached to the associated lever arm 112, 116.

Figure 3:
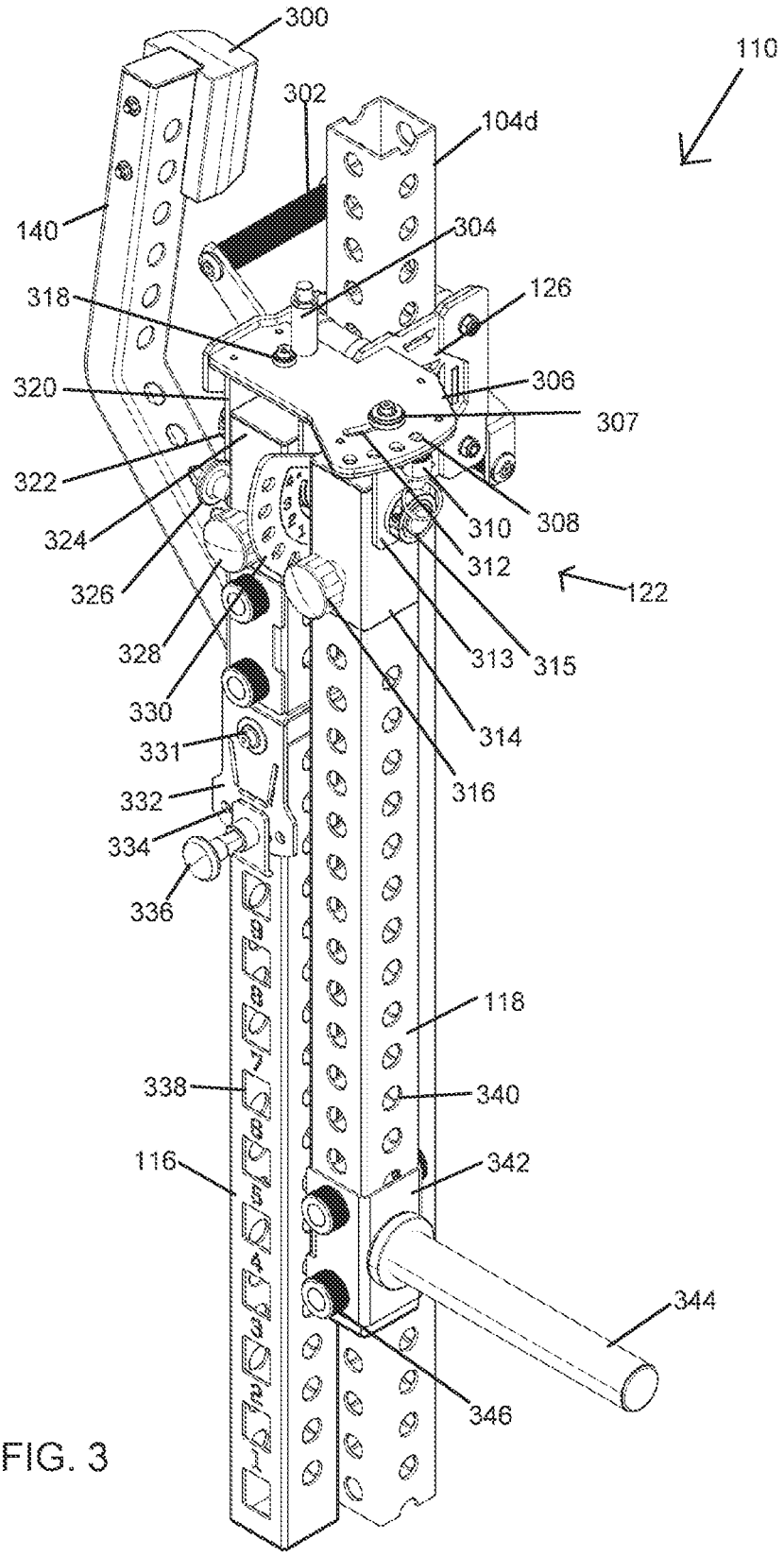
FIG. 3 is a perspective view of a lever jammer arm assembly as part of the machine of FIG. 1.
Figure 4:
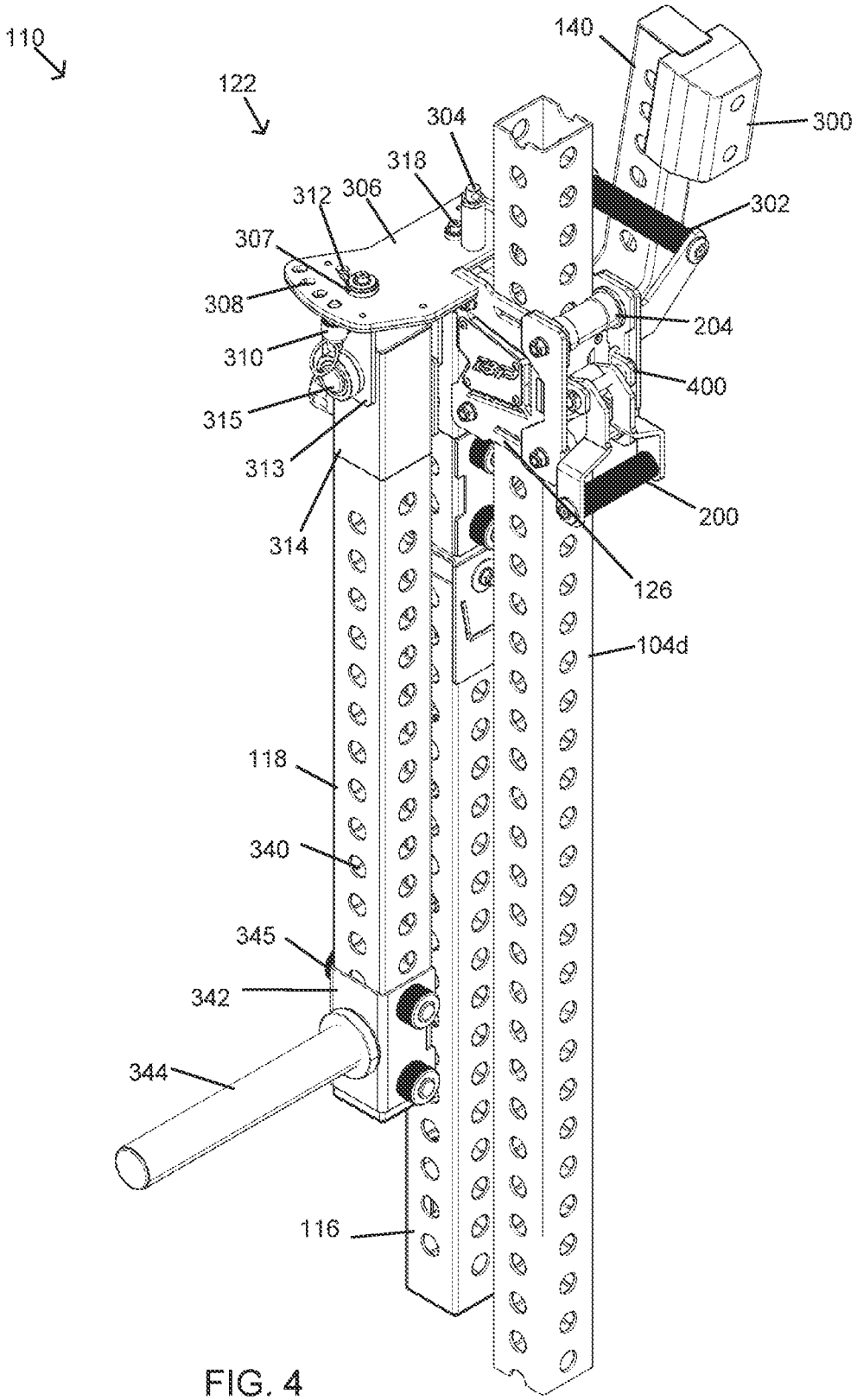
FIG. 4 is another perspective view of the lever jammer arm assembly of FIG. 3.
Figure 5:
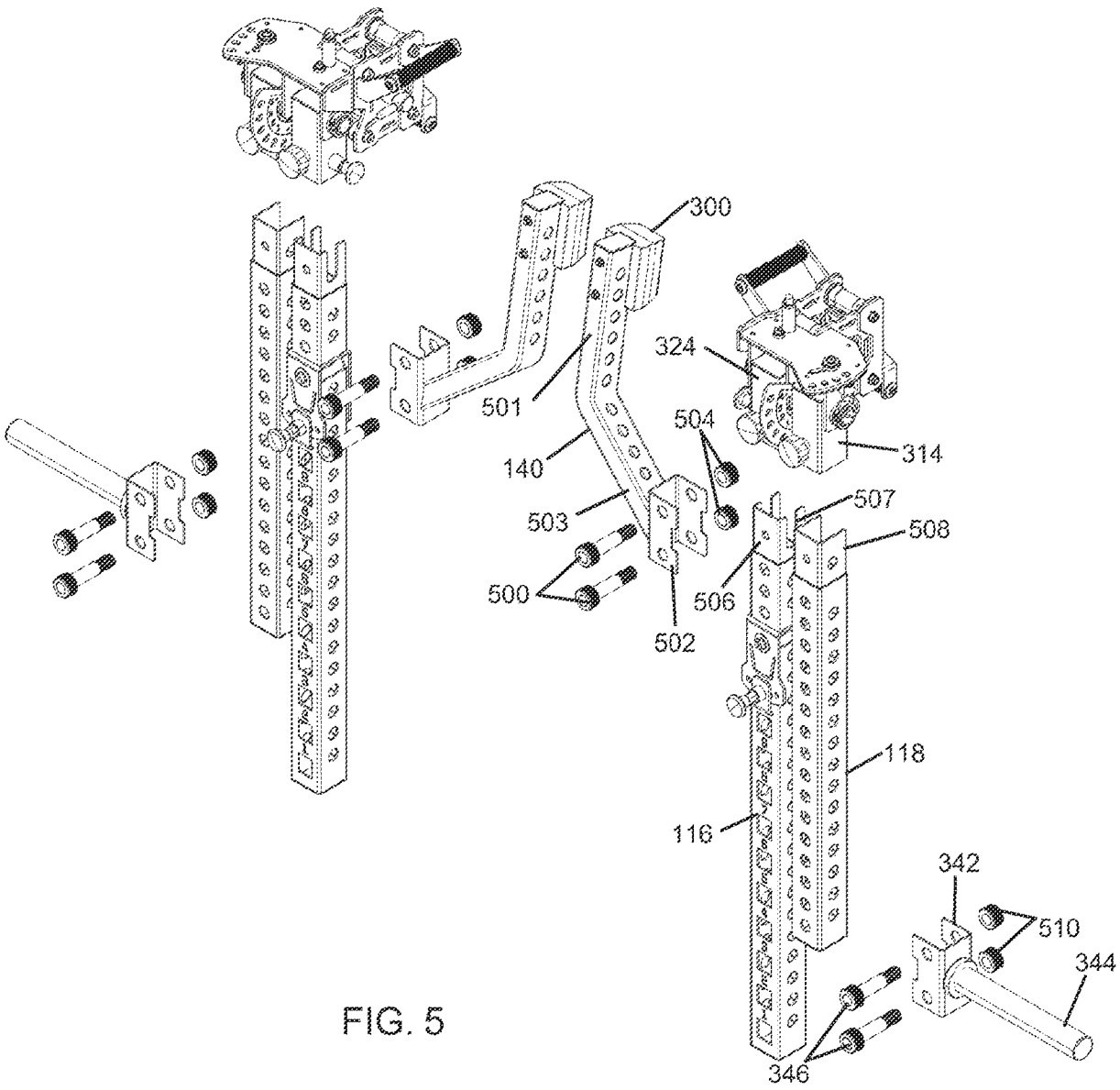
FIG. 5 is a perspective, disassembled view of two lever jammer arm assemblies of FIG. 1.

Turning now to FIGS. 3, 4, and 5, lever jammer arm assembly 110 is shown in detail. Those skilled in the art will recognize that each lever jammer arm assembly 110, 108 includes the same components, or mirror image components, and accordingly, only one assembly 110 is described in detail herein. As shown, the dual arm mechanism 122 is engaged with the vertical post 104*d* via the carriage 126 and rollers 204. The carriage 126 is configured to traverse up and down the vertical post 104*d* via the rollers 204, as well as the one or more handles 200, 302. In some embodiments, at least one handle 200 is attached to the carriage 126 via a pivot joint 400, such that the handle 200 can pivot relative to the carriage 126 and aid in locking the carriage in place along a vertical position.

The dual arm mechanism 122 includes a plate 306 that extends out from the carriage 126 and is substantially perpendicular to the vertical post 104*d*. The plate 306 essentially provides for an upper connection point to support the lever arm and weight arm. Specifically, the plate 306 supports a first tubular member 314 and a second tubular member 324, which each attach to one of the arms 116, 118. Specifically, the first tubular member 314 attaches to the weight arm 118 via a removable pin 316, which inserts through the tubular member 314 and into the weight arm 118 to connect the two. This allows for easy removal of the weight arm 118 from the tubular member 314. Similarly, the second tubular member 324 receives the lever arm 116 and connects to the lever arm 116 via a removable pin 328, thereby again allowing for the lever arm 116 to be removed as needed from the second tubular member 324.

To allow for movement of each arm 116, 118, each of the tubular members 314, 324 is engaged with the plate 306 by member supports 307, 318, which extend through the plate 306 and attach to braces 313, 320 underneath the plate 306. Each brace 313, 320 is then further attached to the associated tubular member 314, 324 via a hinged connection 315, 322. This allows for the tubular member 314, 324, and its associated arm, to rotate and pivot around the associated hinged connection 315, 322. In other words, weight arm 118 is secured to tubular member 314 at an end 508 of the weight arm 118; the tubular member 314 is further secured to the brace 313 via the hinged connection 315; the brace 313 is further attached to the tubular member support 307 which is coupled to the plate 306. Accordingly, this series of connections allows for the weight arm 118 to be removed, adjusted, and also pivoted about the hinged connection 315. In embodiments, the tubular member support 307 extends through a guide channel 312, allowing for the brace 313 to be adjusted in position, via a pin 310 and apertures 308. As needed, the pin 310 can be removed, allowing for the support 307 to be adjusted within the guide channel 312, and then locked back into place at a new angle (see FIG. 6).

The lever arm 116 is able to be adjusted in a variety of ways. Specifically, an angular adjustment guide plate 330 extends from plate 306 and allows for the lever arm 116 to be lifted away from the vertical post 104*d* and secured at an angle relative to the vertical post (see FIG. 7). The lever arm 116 is locked into the desired angle via another pin 326 extending through tubular member 324 and through a cutout 507 of an end portion 506 if the lever arm 116. This connection allows for the tubular member 324 and lever arm 116 to move in tandem without the pin 326 blocking movement. In addition, a pivot adjustment brace 332 connects an upper portion of the lever arm to a lower portion. The pivot adjustment brace 332 connects the upper portion to the lower portion at another hinged connection 331 such that the lower portion can pivot from side to side (see FIG. 8) and lock in place via apertures 334 and a pin 336. The user can pivot the lever arm 116 inward into a desired position based on an exercise to be performed. Accordingly, the lever arm 116 can be adjusted vertically and in a side-to-side plane.

Those skilled in the art will appreciate that each of the weight arm 118 and lever arm 116 also include associated apertures 340, 338 to allow for attachment of secondary devices. Specifically, a weight receiver 344 extending from a coupling 342 can attach at various locations on the weight arm 118 via additional pins 346 and pin receivers 510. As shown, in embodiments, the lever arm 116 may include labels associated with some of the apertures, thereby directing the user to specific locations. In addition, the lever arm may include varying shapes of apertures, such as square/rectangular extending from the front, with round extending from the sides.

As best shown in FIG. 5, the pivot arm 140 may include a first portion 503 and a second portion 501. The first portion 503 can secure along the lever arm 116 via a coupling 502 with pins 500 and pin receivers 504. The first portion 503 extends the pivot arm 140 away from the lever arm 116 to a bend, wherein the second portion 501 then extends substantially perpendicular to the lever arm 116 and to a stop 300. In other words, the pivot arm 140 is not straight, but rather includes two portions connected at a bend.

Figure 6:
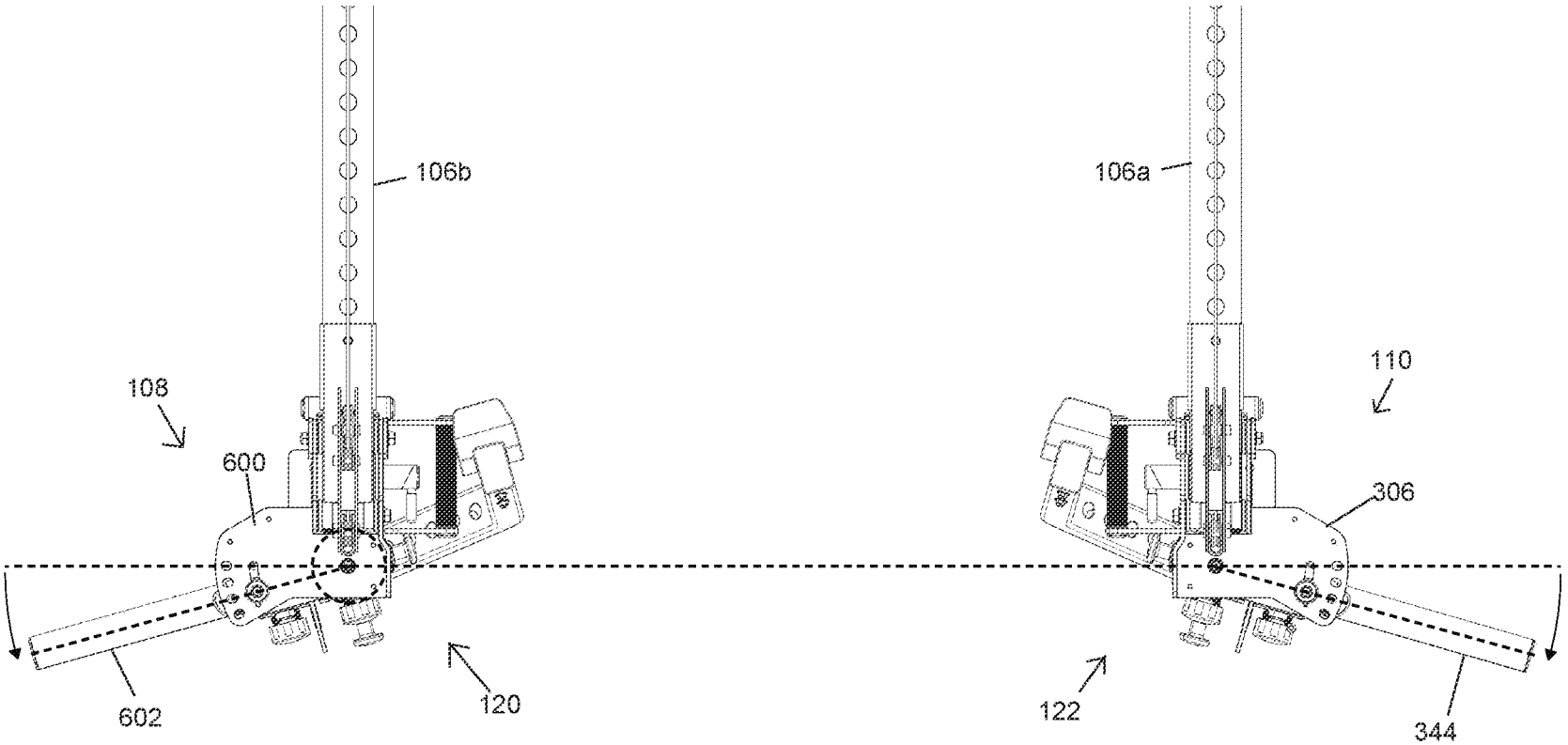
FIG. 6 is a top view of the lever jammer arm exercise machine of FIG. 1 with a first weight arm of a first lever jammer arm assembly and a second weight arm of a second lever jammer arm assembly pivoted into second positions.

FIG. 6 depicts a top view of the lever jammer arm assemblies 108, 110, showing the dual arm mechanisms 120, 122 allowing for outward positioning of the weight receivers 344, 602 from plates 306, 600. This figure demonstrates one element of adjustment, namely that the weight arms and receivers 344, 602 can pivot outwardly from a vertical plane.

Figure 7:
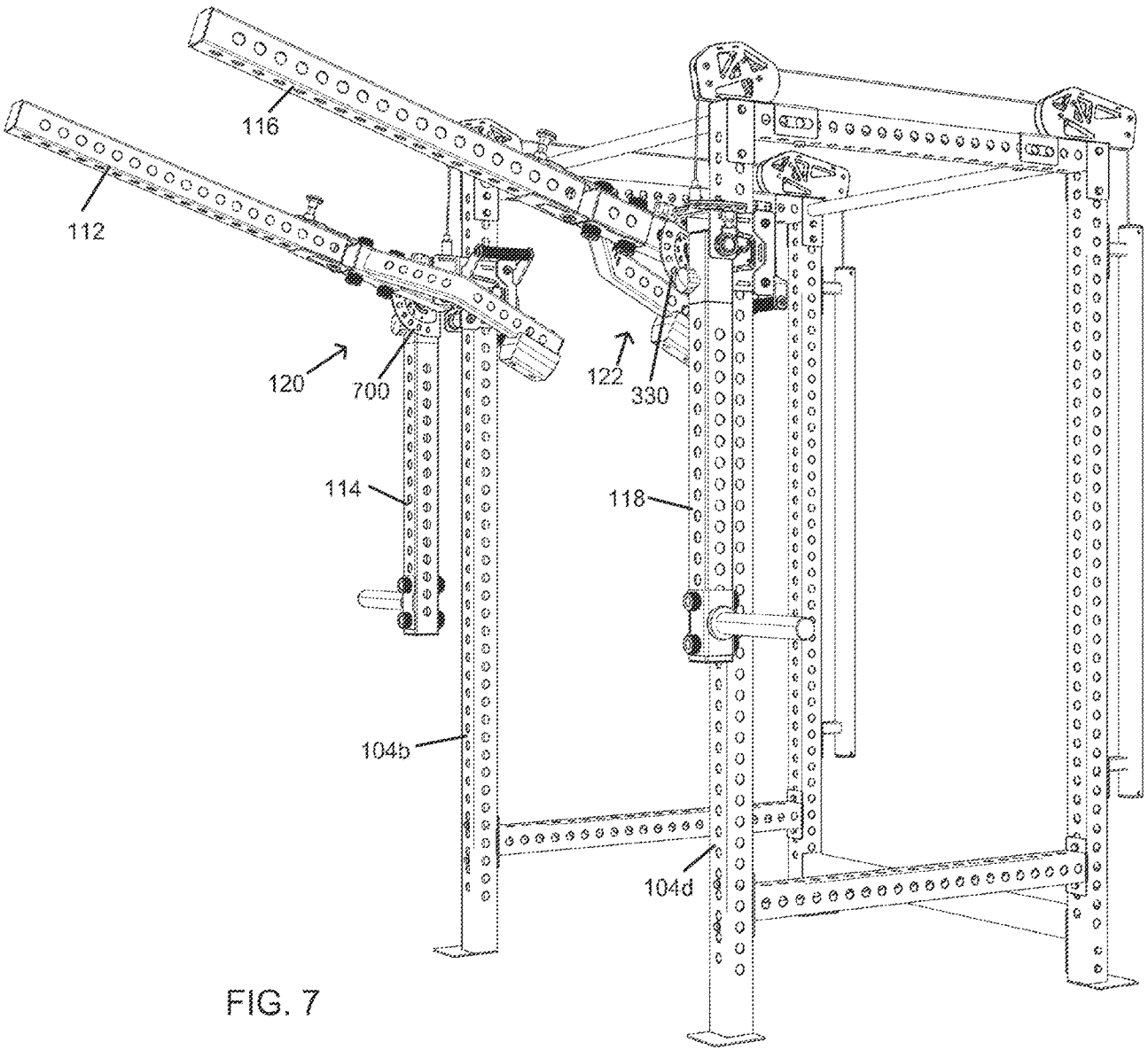
FIG. 7 is a perspective view of the lever jammer arm exercise machine of FIG. 1 with a first lever arm of the first lever jammer arm assembly and a second lever arm of the second lever jammer arm assembly pivoted upwards into second positions.

FIG. 7 depicts a perspective view showing another adjustment. Namely, the lever arms 112, 116 are raised and secured away from the associated vertical posts 104*b* 104*d*. This is specifically accomplished via the angular adjustment guide plates 330, 700 and pins locking into said plates 330, 700.

Figure 8:
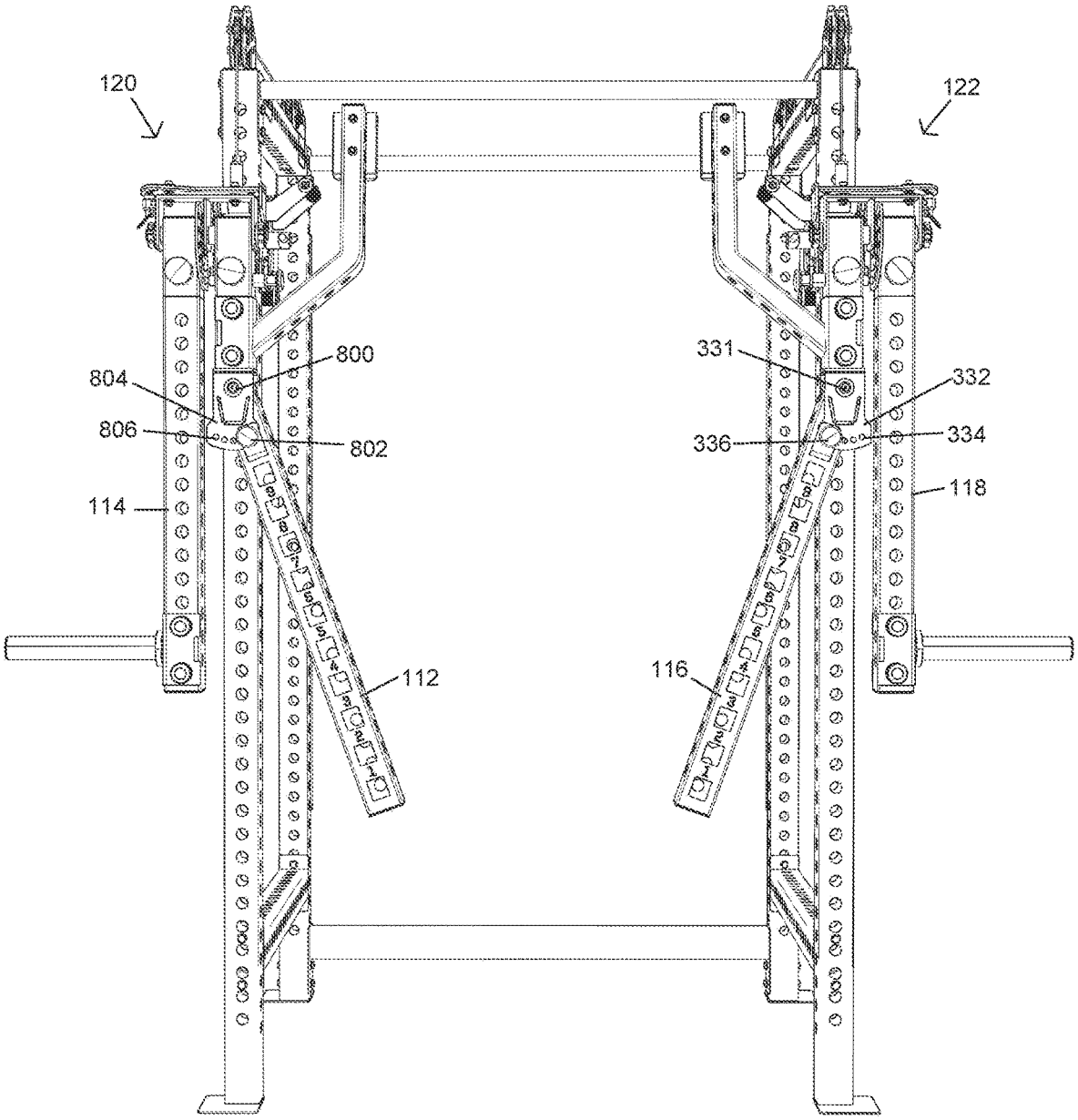
FIG. 8 is a front view of the lever jammer arm exercise machine of FIG. 1 with bottom portions of the first lever arm and the second lever arm each pivoted inwardly into third positions.

FIG. 8 depicts a front view showing the side-to-side adjustment of the lever arms 112, 116 via the pivot braces 332, 804. Specifically, each lever arm 112, 116 is pivoted inward about the associated hinged connection 331, 800, and then locked into place via pins 336, 802, and apertures 806, 334.

The user can utilize any combination of the above adjustments to set up the machine 100 as desired for the exercise to be performed. Accordingly, the machine 100 allows for a diverse range of exercises to be performed, with minimal additions or deletions. This reduces the overall cost of exercise equipment, as the user can limit the number of purchases. Further, this reduces the needed footprint for equipment in both a home and gym setting.

Figure 9:
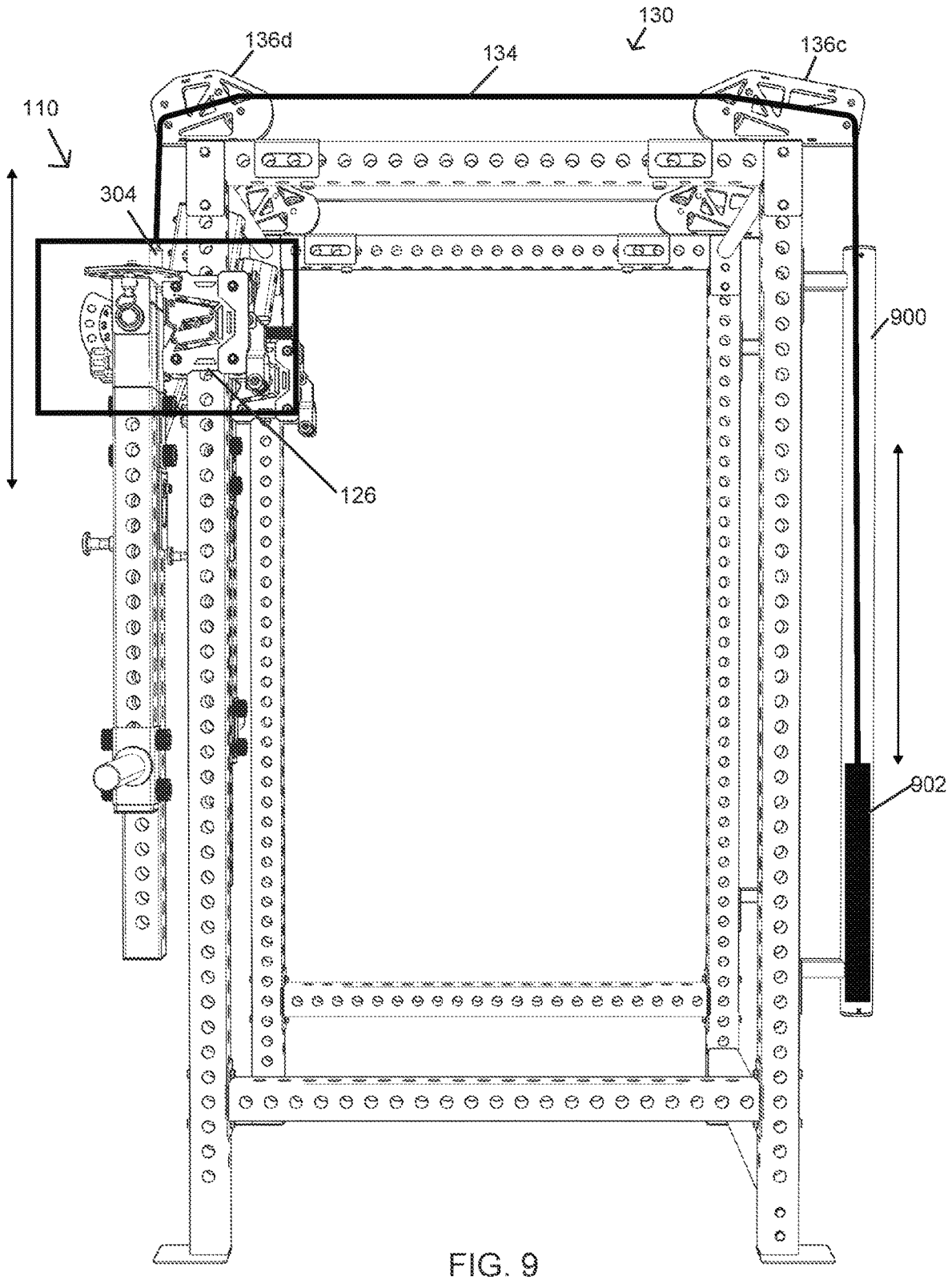
FIG. 9 is a side view of the lever jammer arm exercise machine of FIG. 1 showing a cable system with a cable extending from the first lever jammer arm assembly to a first counterweight.

FIG. 9 demonstrates cable system 130 in more clarity. As shown, the cable system 130 includes the cable 134 that extends over the support structure and secures to a cable attachment 304 as part of the lever jammer arm assembly 110. The cable 134 extends through guides 136*c-d*, such that the cable travels into a housing 900 to engage with counterweights 902. As shown with arrows, as the lever jammer arm assembly 110 traverses up and down the vertical post via carriage 126, so do the counterweights 902. This provides for support to the lever jammer arm assembly 110 as it is adjusted vertically by the user. Those skilled in the art will appreciate that the cable system 130 may vary without departing from the intent of the present invention. For example, although housing 900 is shown in a tubular configuration, other configurations may be useable with minimal adaptation.

Figure 10:
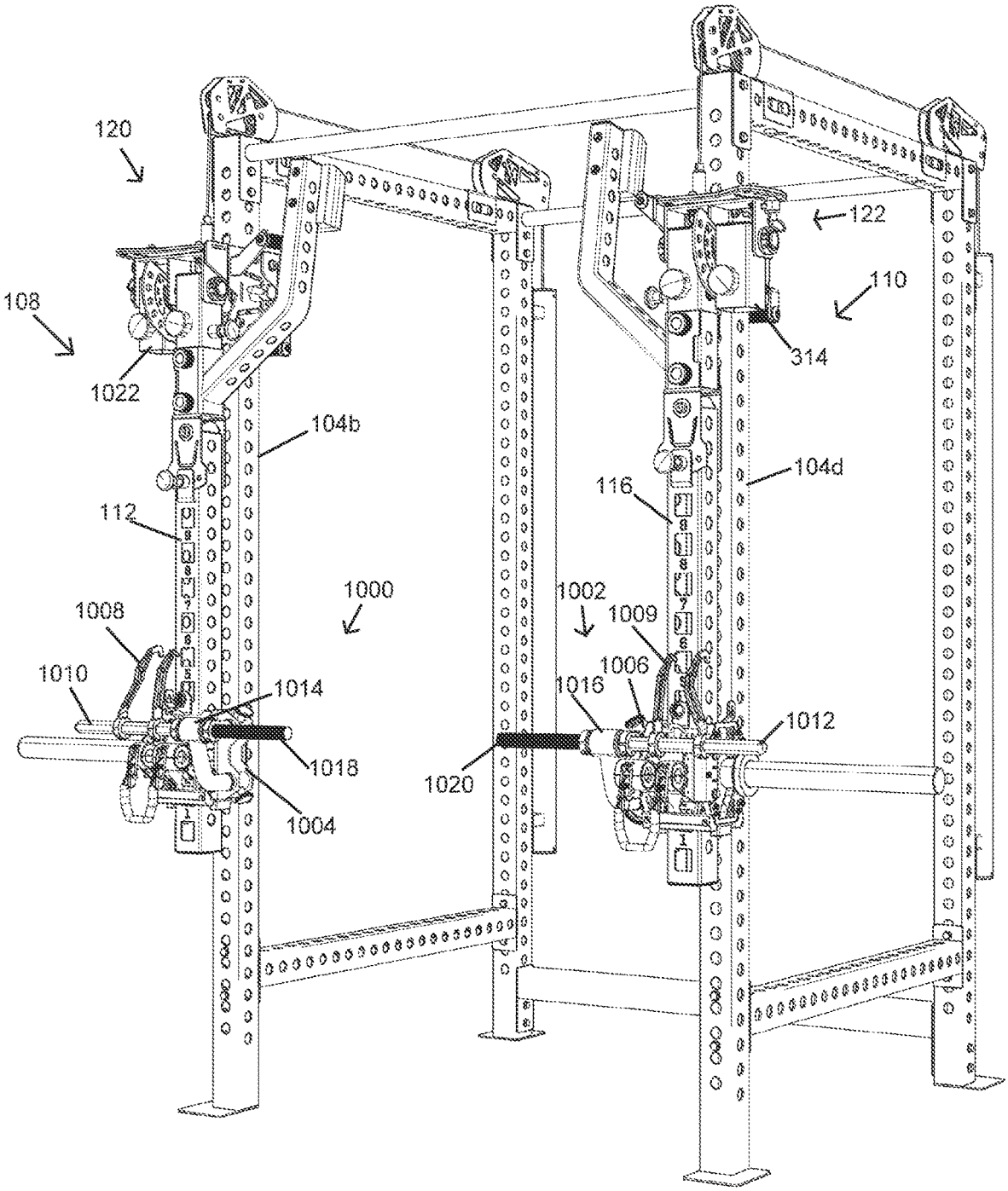
FIG. 10 is a perspective view of the lever jammer arm exercise machine of FIG. 1 with a first user engageable system.
Figure 11:
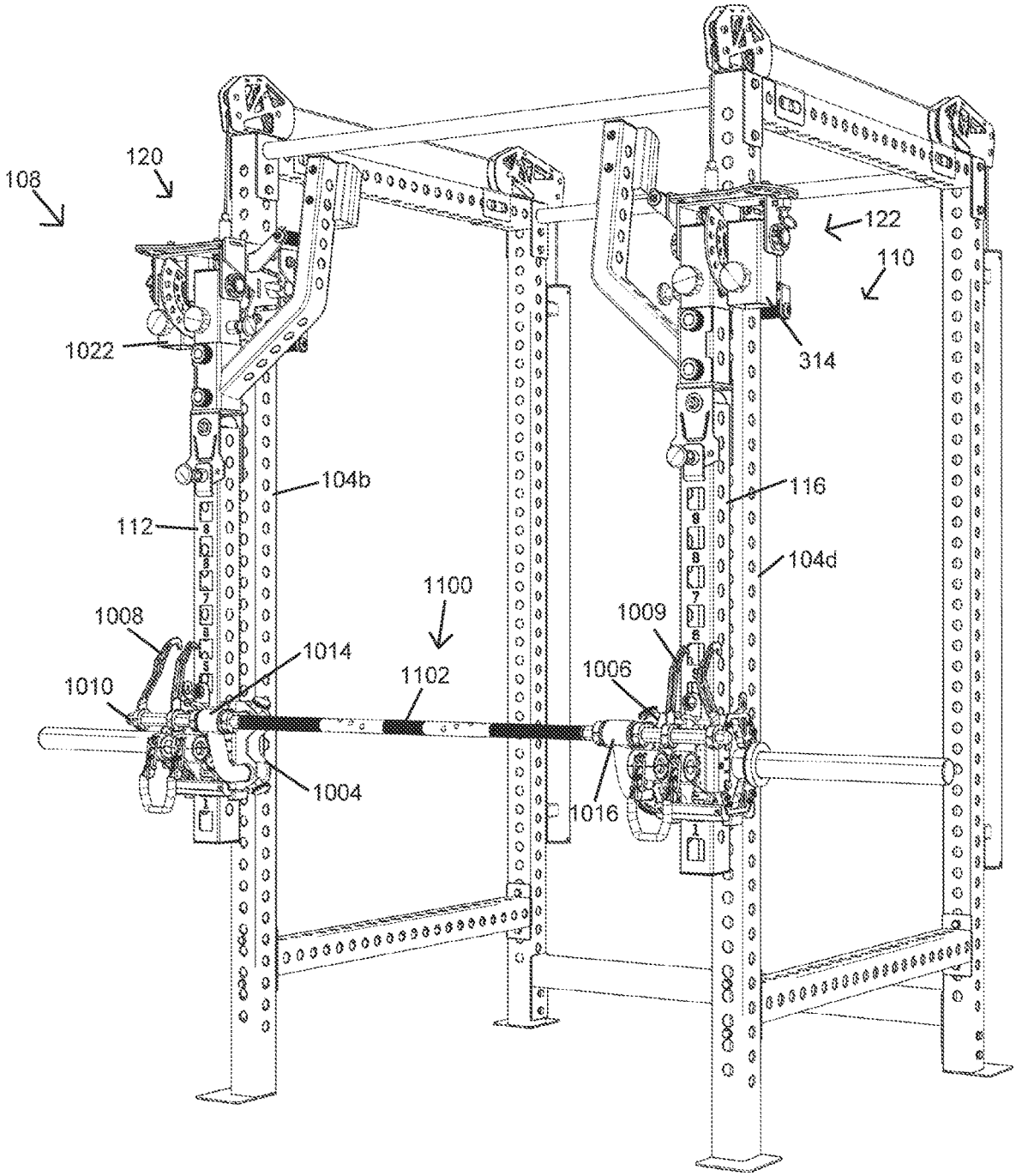
FIG. 11 is a perspective view of the lever jammer arm exercise machine of FIG. 1 with a second user engageable system.

FIGS. 10 through 13 depict some examples of user engageable systems for use with the lever jammer arm exercise machine 100. These are merely exemplary and may be changed, modified, or otherwise altered from those shown. In FIG. 10, independent user engageable systems 1000, 1002 are shown, each attached to an associated lever arm 112, 116. These systems 1000, 1002 show the use of secondary carriages 1004, 1006 for coupling to the associated lever arm 112, 116, the carriages 1004, 1006 configured to traverse along the associated lever arm 112, 116. Handles 1018, 1020 are coupled to receivers 1014, 1016 as part of the systems 1000, 1002. The handles 1018, 1020 are removable and can vary in size and other features and qualities as would be understood by those skilled in the art. This embodiment further shows the potential use of hooks 1008, 1009 for further locking into the associated lever arms 114, 116, the hooks 1008, 1009 coupled to bars 1010, 1012 for structural security. In FIG. 11, the same configuration is shown, except this system 1100 includes a bar 1102 extending between receivers 1014, 1016.

Figure 12:
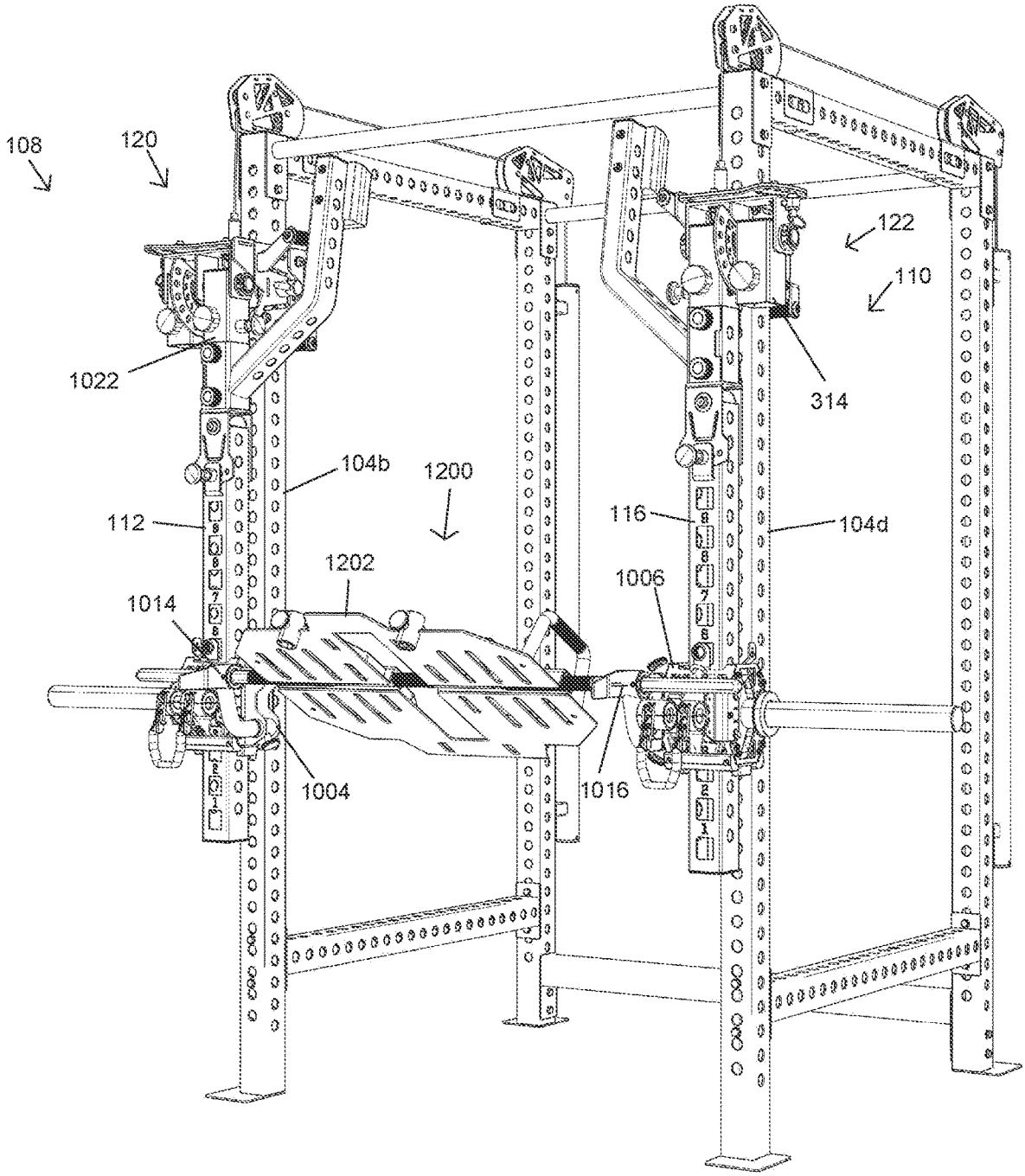
FIG. 12 is a perspective view of the lever jammer arm exercise machine of FIG. 1 with a third user engageable system.
Figure 13:
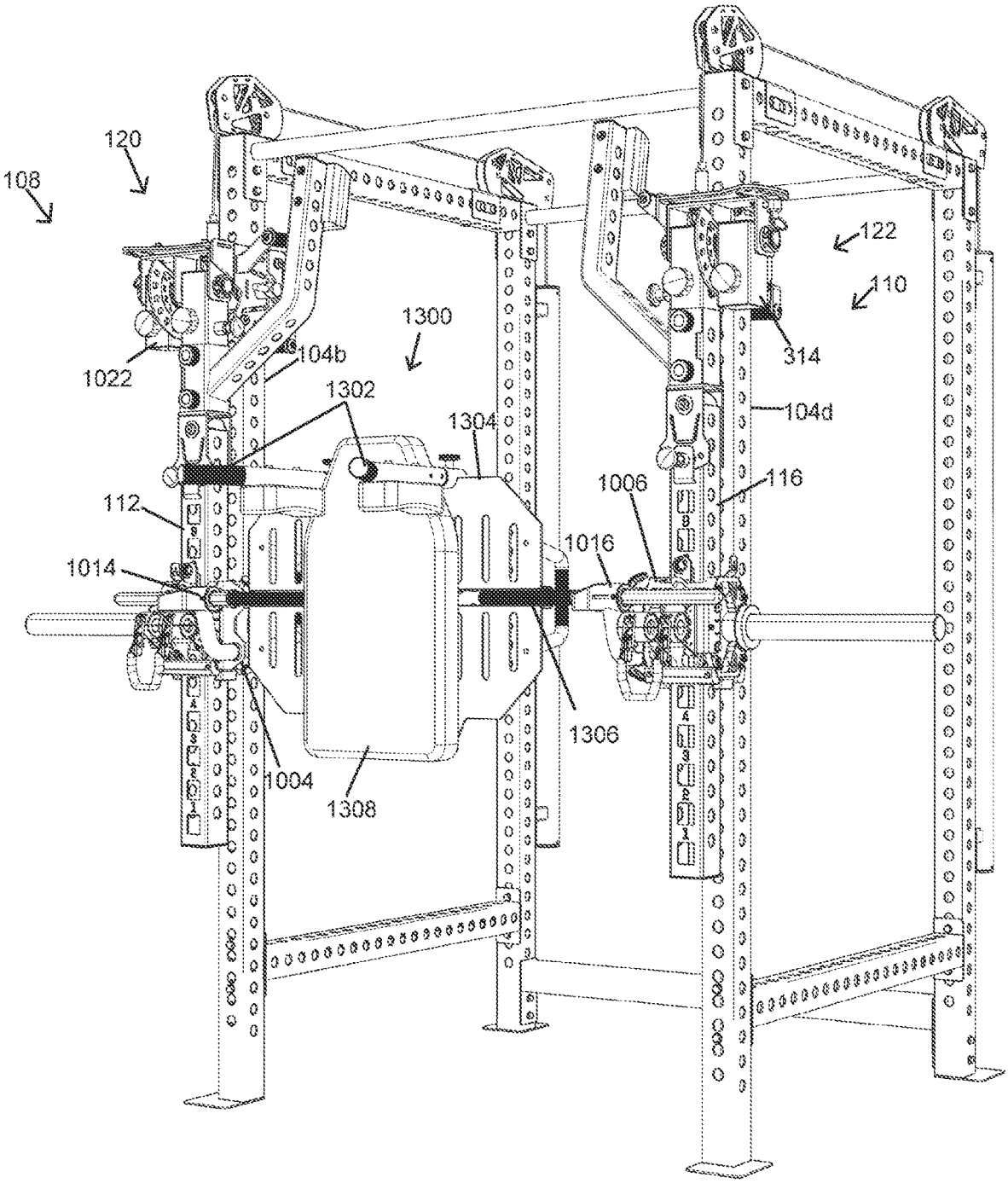
FIG. 13 is a perspective view of the lever jammer arm exercise machine of FIG. 1 with a fourth user engageable system.

In FIG. 12, another user engageable system 1200 is shown for example. Here, a plate 1202 is positioned between receivers 1014, 1016 for additional optional exercises. Lastly, in FIG. 13, another user engageable system 1300 shows a body pad 1308 with handles 1302 as supported via a plate 1304. Here, another bar 1306 extends to receivers 1014, 1016.

Again, the examples shown above are only a few of the potential user engageable systems contemplated and additional systems may be added or created as would be understood by those skilled in the art.

In FIGS. 14-16, detailed view of one of the dual arm mechanisms 122 are shown for clarity. Again, the dual arm mechanism 122 allows for a plurality of adjustments. Specifically, the coupling of tubular member 314 to brace 313 via hinged connection 315, and further supported by the plate 306 via a support 307 within a channel 312, allows for the associated weight arm to be adjusted. The pin 310 can lock the weight arm into a position via one of a plurality of apertures 308 once the tubular member support 307 has been adjusted within guide channel 312. FIG. 14 best demonstrates the angular adjustment guide plate 330 which is positioned between the tubular members 324, 314 and can lock tubular member 324 into a vertical position. As shown, a bar 1402 extends through a curved channel 1400 as part of the angular adjustment guide plate 330. This bar guides pivoting of the tubular member 324 until a position is achieved. Once said position is achieved, pin 326 will extend through the tubular member 324 and into one of the apertures 1404. In FIG. 16, spring loaded pin 1600 is best shown, which allows for securing the carriage 126 in a position along the associated vertical post. The pin 1600 extending through the carriage 126 and into one of the apertures of the vertical post.

Those skilled in the art will appreciate that although the term "pin" is used to identify a plurality of components, these components can readily be understood as any style or combination of pin, bolt, screw, bar, or other device that provides the same functions discussed herein.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations. Not all steps listed in the various figures need be carried out in the specific order described.

The invention claimed is:

1. A lever jammer arm exercise machine, comprising:

a support structure having a vertical post;

a lever jammer arm assembly coupled to the vertical post, the lever jammer arm assembly having:

a dual arm mechanism with a carriage coupling the lever jammer arm assembly to the vertical post, the dual arm mechanism having:

a plate coupled to the carriage and extending therefrom;

a first member supported by the plate; and a second member supported by the plate;

wherein the first member and the second member are configured to pivot relative to the plate a weight arm secured to the first member such that the weight arm is configured to pivot with the first member relative to the plate; and a lever arm secured to the second member such that the lever arm is configured to pivot with the second member relative to the plate;

a user engageable system coupled to the lever arm and configured for operation by a user, the user engageable system is removable and changeable from the lever arm to allow for the lever jammer arm assembly to be used for a plurality of exercises.

2. The lever jammer arm exercise machine of claim 1, wherein the dual arm mechanism further comprises:

a first brace coupled to and extending downward from the plate, the first brace attached to the first member via a first hinge connection such that the plate supports the first member and the first member is configured to pivot about the first hinge connection; and a second brace coupled to and extending downward from the plate, the second brace attached to the second member via a second hinge connection such that the plate supports the second member and the second member is configured to pivot about the second hinge connection.

3. The lever jammer arm exercise machine of claim 2, wherein the dual arm mechanism further comprises:

a guide channel extending through the plate; and a member support extending through the guide channel and attached to the first brace to couple the first brace to the plate;

wherein the member support is configured to adjust in position via the guide channel such that the first brace is adjusted along with the first member.

4. The lever jammer arm exercise machine of claim 1, wherein the dual arm mechanism further comprises:

an angular adjustment guide plate positioned between the first member and the second member and supported by the plate, the angular adjustment guide plate includes a plurality of apertures and is configured to support the lever arm at an angle relative to the vertical post; and a pin extending through the second member;

wherein the pin is configured to selectively extend through one of the plurality of apertures to adjust the angle of the lever arm relative to the vertical post.

5. The lever jammer arm exercise machine of claim 1, further comprising:

a pivot arm coupled to the lever arm at a first end and having a stop at a second end, the pivot arm having a bend of less than 180 degrees such that a first portion of the pivot arm extends the pivot arm away from the lever arm and the bend positions a second portion of the pivot arm to a parallel configuration with the lever arm.

6. The lever jammer arm exercise machine of claim 1, wherein the lever jammer arm assembly further comprises:

a pivot brace positioned along the lever arm, the pivot brace connecting a lower portion of the lever arm to an upper portion of the lever arm such that the lower portion is configured to pivot relative to the upper portion; and a pin extending through the pivot brace and into the lower portion of the lever arm such that the lower portion of the lever arm is configured to be locked at a position relative to the upper portion of the lever arm.

7. The lever jammer arm exercise machine of claim 1, further comprising:

a cable system, having:

a plurality of cable guides attached to the support structure;

a cable attached to the plate at a first end and connecting the dual arm mechanism to the plurality of cable guides and extending to a counterweight at a second end;

wherein the cable system provides support to the lever jammer arm assembly via the cable, the plurality of cable guides, and the counterweight.

8. A lever jammer arm assembly, comprising:

a dual arm mechanism with a carriage configured to couple the lever jammer arm assembly to a vertical post, the dual arm mechanism having:

a plate coupled to the carriage and extending therefrom;

a first tubular member supported by the plate; and a second tubular member supported by the plate;

wherein the first tubular member and the second tubular member are configured to pivot relative to the plate a weight arm removably secured to the first tubular member such that the weight arm is configured to pivot with the first tubular member relative to the plate; and a lever arm removably secured to the second tubular member such that the lever arm is configured to pivot with the second tubular member relative to the plate; and a user engageable system coupled to the lever arm and configured for operation by a user, the user engageable system is removable and changeable from the lever arm to allow for the lever jammer arm assembly to be used for a plurality of exercises.

9. The lever jammer arm assembly of claim 8, wherein the dual arm mechanism further comprises:

a first brace coupled to and extending downward from the plate, the first brace attached to the first tubular member via a first hinge connection such that the plate supports the first tubular member and the first tubular member is configured to pivot about the first hinge connection; and a second brace coupled to and extending downward from the plate, the second brace attached to the second tubular member via a second hinge connection such that the plate supports the second tubular member and the second tubular member is configured to pivot about the second hinge connection.

10. The lever jammer arm assembly of claim 9, wherein the dual arm mechanism further comprises:

a guide channel extending through the plate; and a member support extending through the guide channel and attached to the first brace to couple the first brace to the plate;

wherein the member support is configured to adjust in position via the guide channel such that the first brace is adjusted along with the first tubular member.

11. The lever jammer arm assembly of claim 8, wherein the dual arm mechanism further comprises:

an angular adjustment guide plate positioned between the first tubular member and the second tubular member and supported by the plate, the angular adjustment guide plate includes a plurality of apertures and is configured to support the lever arm at an angle relative to the vertical post; and a pin extending through the second tubular member;

wherein the pin is configured to selectively extend through one of the plurality of apertures to adjust the angle of the lever arm relative to the vertical post.

12. The lever jammer arm assembly of claim 8, further comprising:

a pivot arm coupled to the lever arm at a first end and having a stop at a second end, the pivot arm having a bend of less than 180 degrees such that a first portion of the pivot arm extends the pivot arm away from the lever arm and the bend positions a second portion of the pivot arm to a parallel configuration with the lever arm.

13. The lever jammer arm assembly of claim 8, further comprising:

a pivot brace positioned along the lever arm, the pivot brace connecting a lower portion of the lever arm to an upper portion of the lever arm such that the lower portion is configured to pivot relative to the upper portion; and a pin extending through the pivot brace and into the lower portion of the lever arm such that the lower portion of the lever arm is configured to be locked at a position relative to the upper portion of the lever arm.

14. The lever jammer arm assembly of claim 8, wherein the carriage further comprises:

a plurality of rollers configured to engage with the vertical post and allow for the carriage to vertically traverse along the vertical post;

a handle extending from the carriage for operation by a user to adjust the carriage along the vertical post; and a spring loaded pin configured to insert through an aperture of the vertical post to secure the carriage at a predetermined height.

15. The lever jammer arm assembly of claim 8, wherein:

the weight arm includes a plurality of apertures for receiving a weight receiver via a coupling and one or more pins such that the one or more pins extend through the coupling and one or more of the plurality of apertures; and the lever arm includes a first plurality of labeled apertures extending through a front of the lever arm for engaging with a user engageable device.

16. A dual arm mechanism, comprising:

a carriage supporting a plurality of rollers and configured to engage with a vertical post;

a plate coupled to the carriage and extending therefrom;

at least one handle extending from the carriage and configured to allow for a user to traverse the carriage along the vertical post;

at least one pin extending from the carriage and configured to secure the carriage at a vertical position along the vertical post;

a first member supported by the plate; and a second member supported by the plate;

wherein the first member is configured to receive a weight arm; and wherein the second member is configured to receive a lever arm.

17. The dual arm mechanism of claim 16, further comprising:

a first brace coupled to and extending downward from the plate, the first brace attached to the first member via a first hinge connection such that the plate supports the first member and the first member is configured to pivot about the first hinge connection; and a second brace coupled to and extending downward from the plate, the second brace attached to the second member via a second hinge connection such that the plate supports the second member and the second member is configured to pivot about the second hinge connection.

18. The dual arm mechanism of claim 17, further comprising:

a guide channel extending through the plate; and a member support extending through the guide channel and attached to the first brace to couple the first brace to the plate;

wherein the member support is configured to adjust in position via the guide channel such that the first brace is adjusted along with the first member.

19. The dual arm mechanism of claim 16, further comprising:

an angular adjustment guide plate positioned between the first member and the second member and supported by the plate, the angular adjustment guide plate includes a plurality of apertures and is configured to support the second member at an angle relative to the vertical post; and a pin extending through the second member;

wherein the pin is configured to selectively extend through one of the plurality of apertures to adjust the angle of the second member relative to the vertical post.

20. The dual arm mechanism of claim 16, further comprising:

a cable attachment extending from a top surface of the plate and configured to engage with a cable.

* * * * *